US006874259B2

(12) United States Patent
Eriksson et al.

(10) Patent No.: US 6,874,259 B2
(45) Date of Patent: Apr. 5, 2005

(54) DEVICE FOR PREPARING SNOW

(75) Inventors: Gustaf Eriksson, Transtrand (SE); Ulf Erik Thors, Malung (SE)

(73) Assignee: MCS Multicat Systems AB, Transtrand (SE)

( * ) Notice: Subject to any disclaimer, the term of this patent is extended or adjusted under 35 U.S.C. 154(b) by 0 days.

(21) Appl. No.: 10/360,646

(22) Filed: Feb. 10, 2003

(65) Prior Publication Data

US 2003/0177668 A1 Sep. 25, 2003

(30) Foreign Application Priority Data

Feb. 8, 2002 (SE) ..... 0200392

(51) Int. Cl.[7] ..... E01H 4/00
(52) U.S. Cl. ..... 37/222; 37/223
(58) Field of Search ..... 37/219–224, 237, 37/463, 354, 352

(56) References Cited

U.S. PATENT DOCUMENTS 1,782,478 A * 11/1930 Ruth ..... 37/354
3,603,010 A * 9/1971 Polinek ..... 37/353
5,940,995 A * 8/1999 Venhomaa ..... 37/240
6,085,445 A * 7/2000 Kanzler ..... 37/222

FOREIGN PATENT DOCUMENTS

DE 196 48 872 A1 5/1998
EP 882844 A2 * 12/1998 ..... E01H/4/02
WO 01/57321 A1 8/2001

* cited by examiner

*Primary Examiner*—Meredith Petravick
(74) *Attorney, Agent, or Firm*—Young & Thompson

(57) ABSTRACT

A device for working a snow surface, includes an endless flexible band, snow-working members arranged on the outside of the band, support elements for supporting and guiding the band, drive elements capable of moving the band around the support elements. Shaping elements are arranged and designed such as to be capable of changing the shape of the part of the band that is in contact with the snow-surface during work.

7 Claims, 13 Drawing Sheets

DEVICE FOR PREPARING SNOW

TECHNICAL FIELD

The present invention relates to a device for preparing a snow surface in a ski run area, especially for finishing previously formed or worked snow surfaces, like half-pipes, jumps and other complexly shaped snow surfaces. The device is intended to be attached to a work unit, capable of handling the device in a plurality of directions and ways in order to follow the shapes of the snow surface to be finished.

BACKGROUND OF THE INVENTION

For ski resorts, special vehicles are used in preparing the foundation for the ski runs and the cross-country trails. These special vehicles, so called snowgrooming vehicles, are track-driven in order to be able to manoeuvre. They are equipped with snow forming devices that are pulled behind for smoothing the surface. Further they are arranged with hydraulically manoeuvred ploughs in the front for transporting snow, such as to cut off bumps and fill deeper tracks and cavities.

During recent years the demands on a more varied skiing in the ski runs has increased, in particular with the arrival of snowboard and its utilisers, but also for ordinary skiing. For that the ski run areas have been designed with different "artificial" configurations, such as mogules, jumps and so called half-pipes. The latter is mainly U-shaped runs where the riders go up and down on the sides and perform different tricks and stunts. These designs demand relatively large amount of work to build up and maintain, for which the conventional snowgrooming vehicles are not optimally designed.

In order to overcome the drawbacks associated with the conventional machines and devices used for creating specially shaped ski-areas, patent application PCT/SE01/00206, discloses a working device comprising an arm rotatably arranged to a stand and that the arm is jointed. The arm is further also slidable in the longitudinal direction for altering the length of the arm. At the end of the arm, a number of different work tools can be attached, such as for example a thrower for removing and forming larger amounts of snow, a preparation device for fine preparation, shovel, work platform, bush cutter, gripping means, and other tools. The stand is designed as an individual self-supported unit that can be releasably attached to a vehicle.

This makes it very simple to attach and detach the device according to need, which provides a very flexible way of working and which for example provides for a snowgrooming vehicle, which is used in ski run areas for preparing the ski runs, to readily attach the device in order to perform machining and preparations of half-pipes and the like. Due to the design of the arm with its joint and the moving in and out of the outreach, advantages are obtained in that a very good control of the working unit can be achieved regarding the desired forms, radii and the like and in that the working area can be varied from very small protrusions to the really large half-pipes with wall heights of up to 6 meters.

The device according to PCT/SE01/00206 utilizes according to one embodiment a snow thrower specially adapted for the working and forming of snow surfaces such as half-pipes. This comprises a rotor with teeth designed and arranged such that a very good working is obtained also on very hard packed snow and where the worked snow can be controlled partly for obtaining an even worked surface, partly for removing and placing of the snow to selected places and partly.

However, the described snow-thrower, that is capable of moving large amounts of snow, is not ideal for finishing work, ie to prepare the shaped surfaces of a ski-area after a days use. These kinds of surfaces, such as half-pipes, often have track-marks, grooves and the like, that have to be removed or smoothed out, which means that it is only the very top layer that has to be worked, and quite often rather small amounts of snow that has to be moved.

BRIEF DESCRIPTION OF THE INVENTION

The aim of the present invention is to provide a device that is capable of performing finishing work on previously shaped snow-surfaces, which means that it shall follow the specific shapes previously made, in a simple and effective way.

According to one aspect of the invention, the present invention discloses a device for working a snow surface, comprising an endless flexible band, snow-working members arranged on the outside of the band, support means for supporting and guiding the band, drive means capable of moving the band around the support means, characterised in shaping means arranged and designed such as to be capable of changing the shape of the part of the band that is in contact with the snow-surface during work.

According to another aspect of the invention, it is characterised in that the shaping means is capable of changing the curvature of the part of the band that is in contact with the snow-surface during work.

According a further aspect of the invention, it is characterised in that the shaping means is capable of changing the part of the band that is in contact continuously and steplessly and that the drive means is capable of moving the band in both directions.

According to yet an aspect of the invention, it is characterised in that it comprises an attachment means for attachment to a manoeuvring means that it is manoeuvrable in at least one degree of freedom.

The advantages with the device according to the present invention are several. Because the shape of the part of the snow-finishing device that is in contact with the surface to be treated, the form of any previously shaped surface can be followed, and if the shape of the surface changes, it is easy to change the shape, and in particular the curvature, of the snow-finishing device. In that way the snow-finishing device can be used for all types of shaped surfaces, like for instance in half-pipes for snow-boards where parts of the half-pipe is curved while other parts are more or less planar. Of course, the shape of the snow-finishing device need not be adapted only to previously shaped surfaces, but may also be used to form specific shapes. The design of the snow-finishing device makes it ideal for preparing snow surfaces in ski areas that have been ridden on during a day, so that the surfaces are prepared and ready for the next day.

Because the snow-finishing device preferably is attached to a work unit that is maneouvrable in at least three degrees of freedom, a very flexible device is obtained with a large work area. Due to the jointed arm arrangement movable along three coordinate axes, complex forms, such as for example the sides of a half-pipe, can be followed in a labour saving and at the same time exact way. When further the snow-finishing device is jointly, and also rotatably, arranged to the work unit, a very exact steering is obtained for optimal result.

These and other aspects of, and advantages with, the present invention will become apparent from the following detailed description of some embodiments of the present invention and from the accompanying drawings.

BRIEF DESCRIPTION OF THE DRAWINGS

In the following detailed description of the invention, reference will be made to the drawings, of which

DETAILED DESCRIPTION OF THE INVENTION

Figure 1:
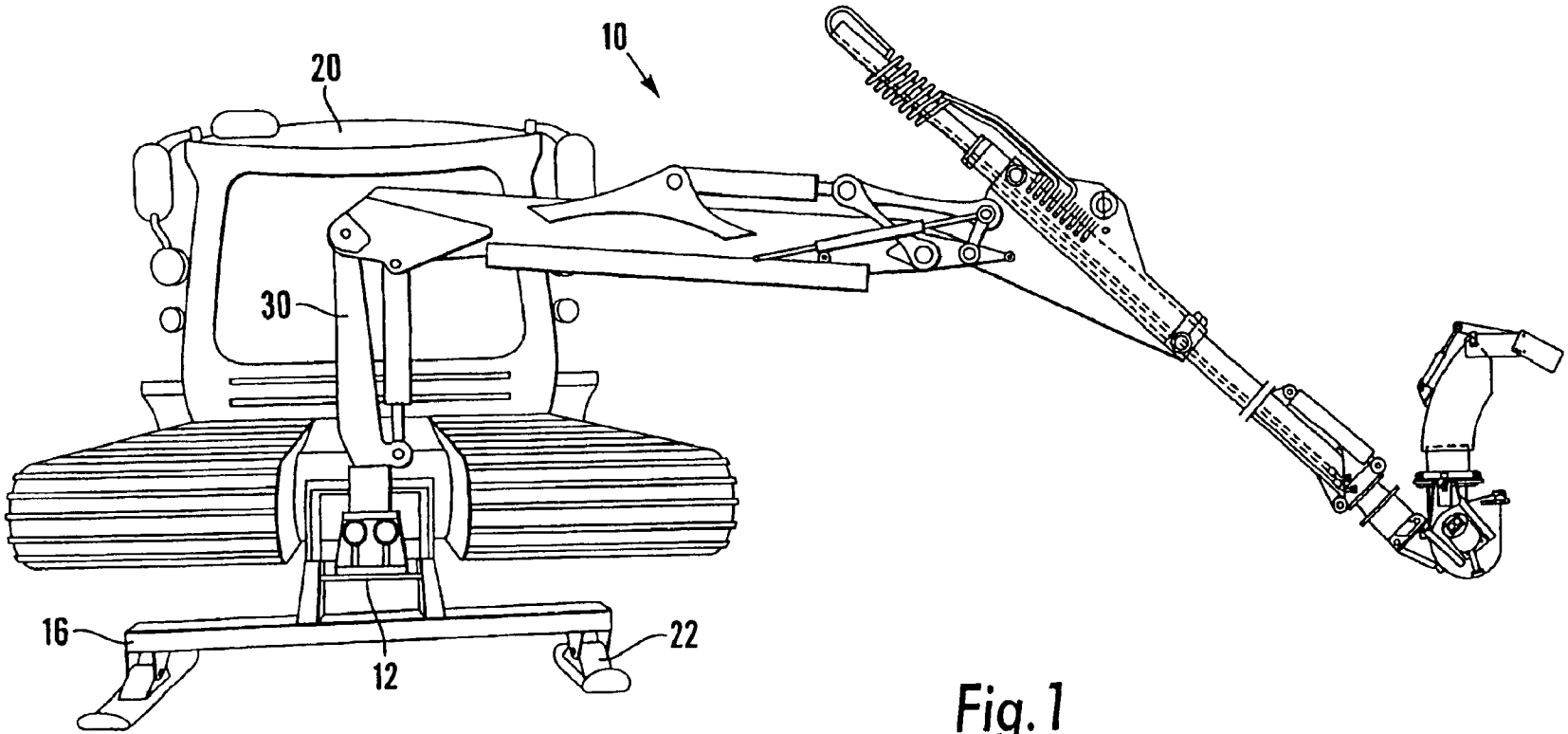
FIG. 1 shows a plan view of the device according to the present invention attached to a work unit which in turn is attached to a snow-grooming vehicle.

The snow finishing device according to the invention is intended to be releasably attached to a work unit for performing work tasks 10. As is shown in FIG. 1 the work unit comprises a stand 12 arranged with an attachment (not shown) for attachment to the tool attachment arranged in the front of a snow-grooming vehicle 20. In this context it shall be understood that other machines, such as wheel loaders, can attach the device according to the invention to its tool attachment, if certain work tasks shall be performed that do not require a snow-grooming vehicle.

Hydraulic attachments (not shown) are arranged between the hydraulic system of the vehicle and the stand 12 via quick couplings.

On the front transversal beam 16 support members, in this case skis, are arranged.

A pillar 30 is rotatably attached to the stand 12. A hydraulic motor (not shown) is attached to the pillar for the turning of this. To the upper end of the pillar a boom 32 is pivotably arranged. At the outer end of the boom 32 a second boom 37, hereafter named outreach, is jointly arranged, FIG. 1. Between the boom and the outreach a hydraulic cylinder 38 is arranged, which acts on the outreach. The outreach is designed with a support part 41 with a longitudinal compartment. In this compartment an arm 43 is slidably arranged for forward and reverse movement.

Figures 2A, 2B:
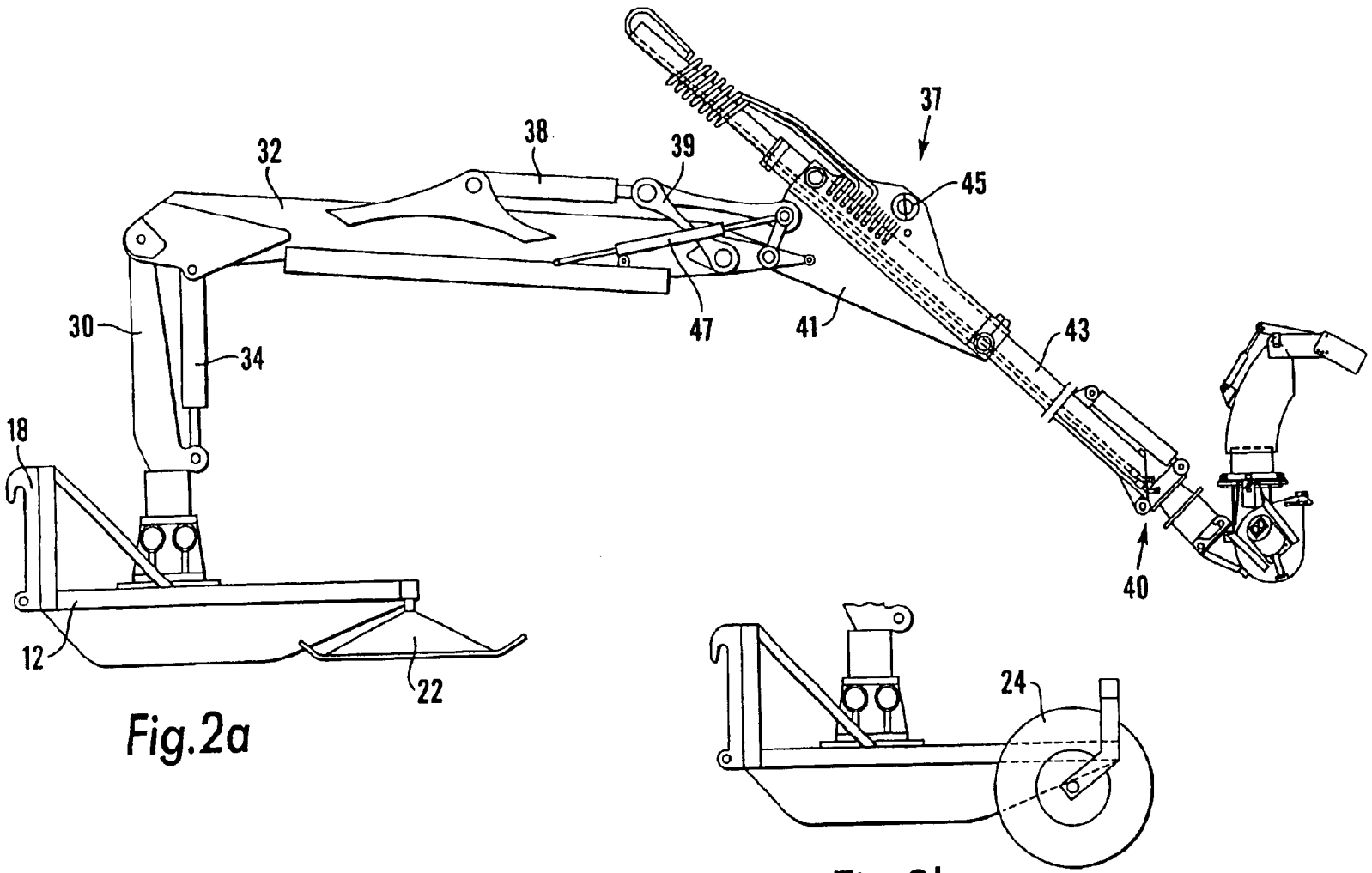
FIG. 2 shows a detailed view of the attachment between the snow finishing device according to the present invention and a manoeuvring means.

In the outer end of the arm a guide member 40 is arranged, FIG. 2. The guide member comprises an attachment plate 42 pivotably attached to the arm. A hydraulic cylinder 44 is arranged between the attachment plate 42 and the guide member 40. To the attachment plate 42 a rotation attachment 46 is attached. The rotation attachment comprises a hydraulic motor (not shown) connected to the hydraulic system of the device. To the rotation attachment a first connection plate 50 is arranged, which displays locking bolts 52. The locking bolts are intended to fit into corresponding recesses in a second connection plate 54 attached to a working unit 60. When the locking bolts have been inserted in the second connection plate, both connection plates are locked with hydraulically driven locking pistons (not shown).

FIGS. 5–15 show an embodiment of a snow-finishing device 60 according to the invention. It comprises a hollow column 62. Inside the column a rod 64 is arranged telescopically, which is urged upwards by a compression spring (not shown) arranged inside the column. At the upper end of the rod two pressure wheels 66 are rotatably arranged, one on each side of the rod. On the side of the column an attachment plate 68 is pivotably arranged. A hydraulic piston/cylinder 70 is arranged between the outer edge, as seen from the column, of the attachment plate and the lower part of the column, for enabling a controlled pivoting of the attachment plate in relation to the column.

Figure 3:
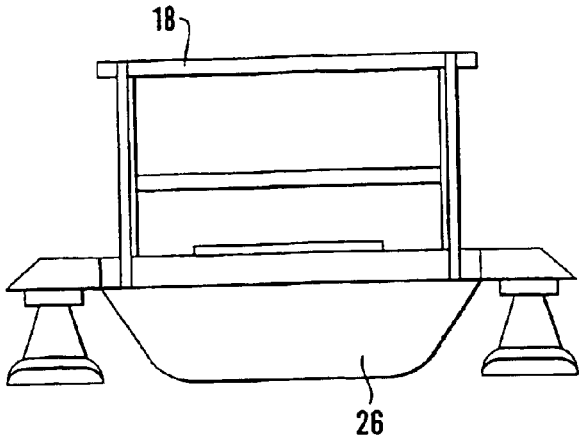
FIG. 3 shows a side view of the snow finishing device according to the present invention.
Figure 4:
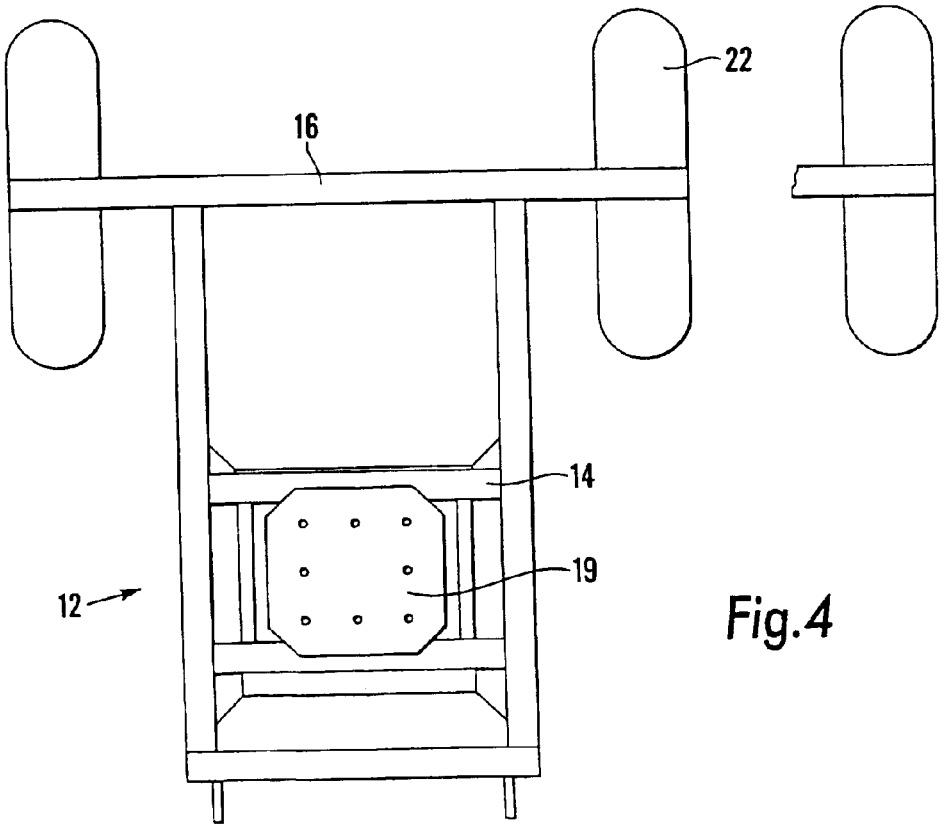
FIG. 4 shows an end view of the snow finishing device according to FIG. 3, and FIGS. 5–15 show different positions of the snow finishing device.
Figure 5:
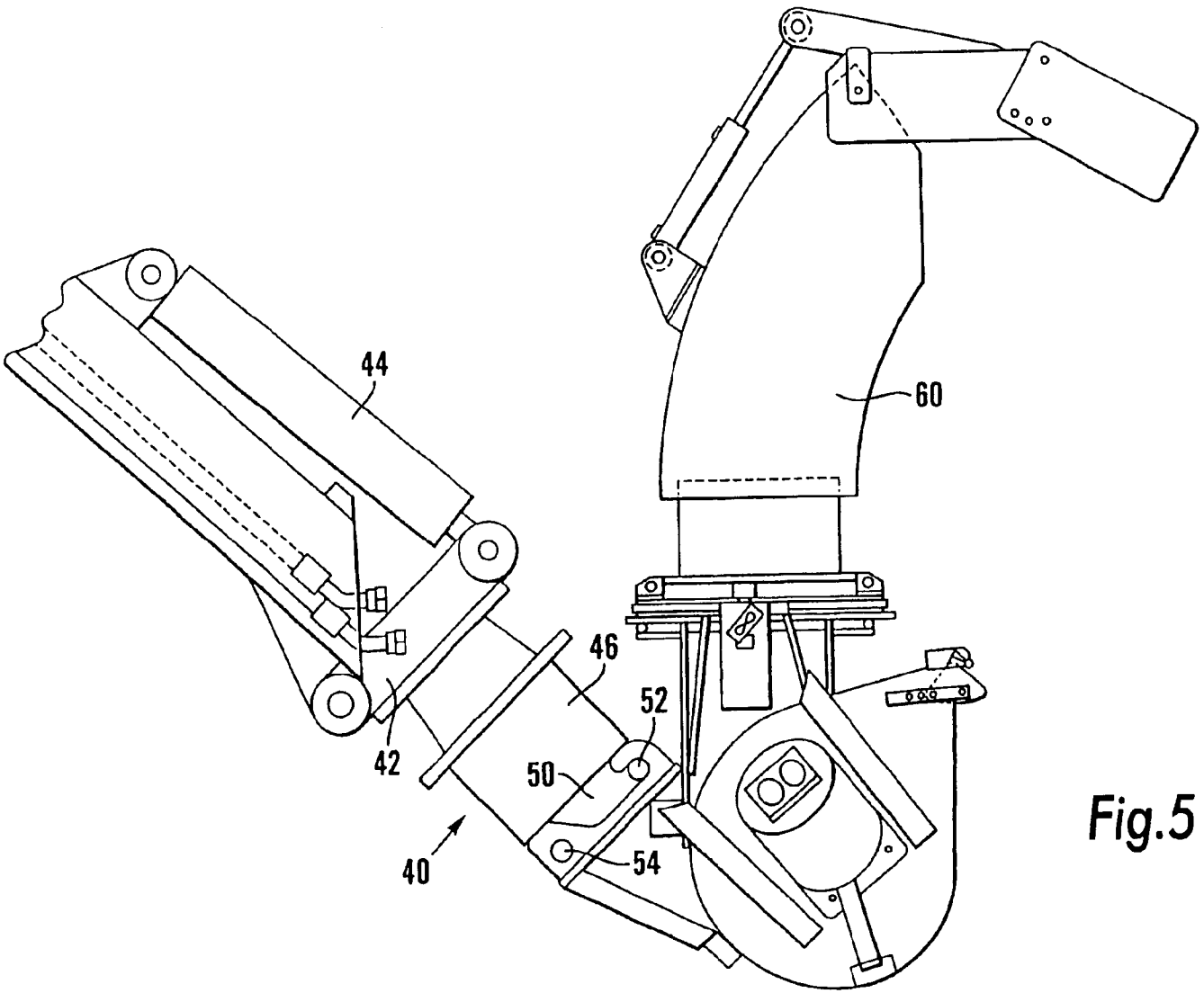
Figure 6:
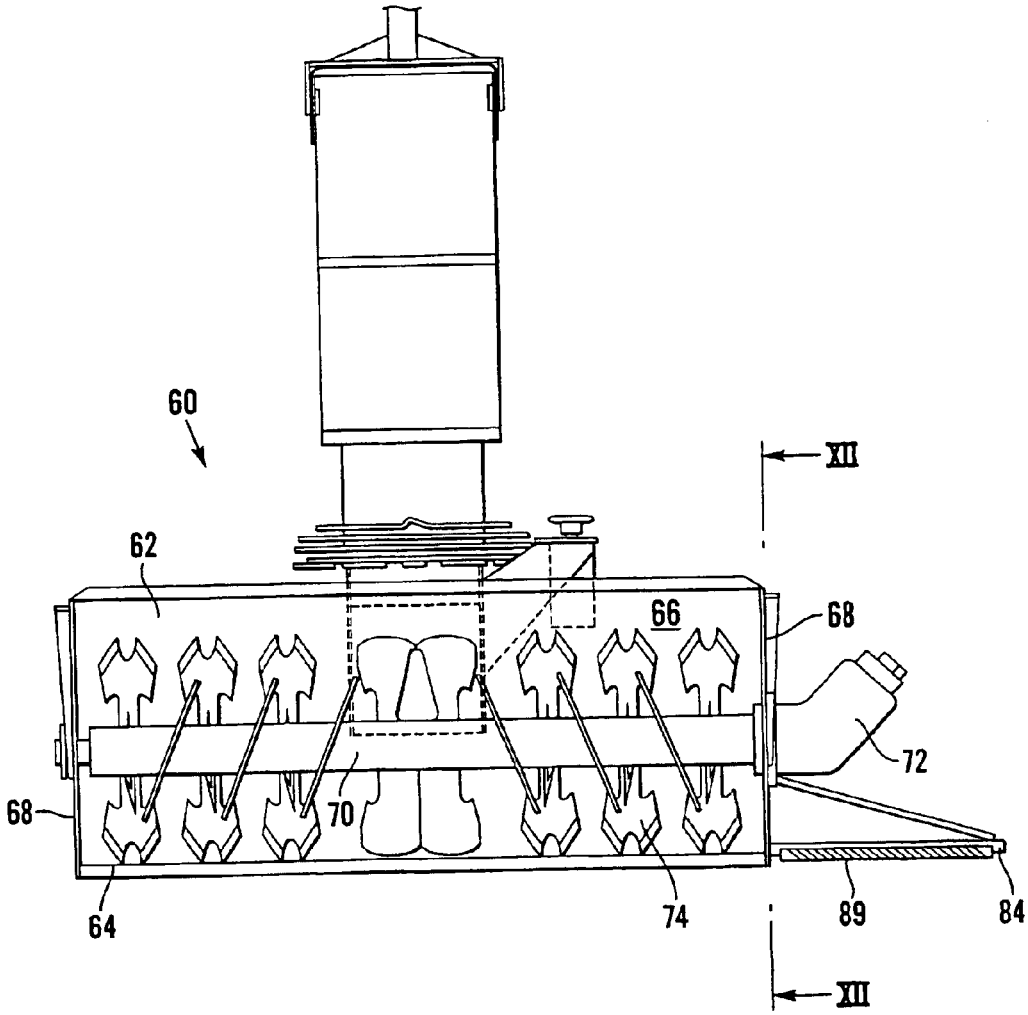
Figure 7:
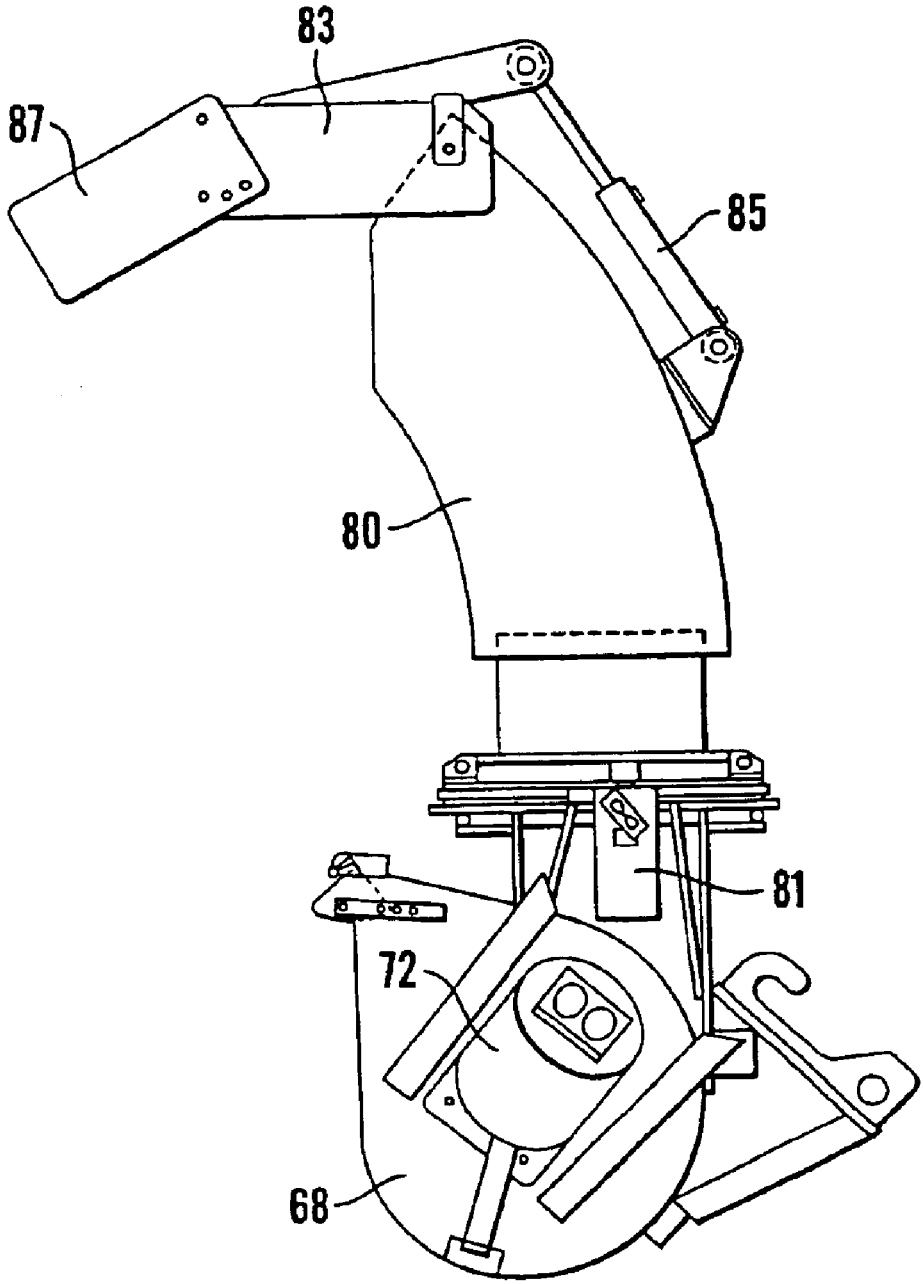
Figure 8:
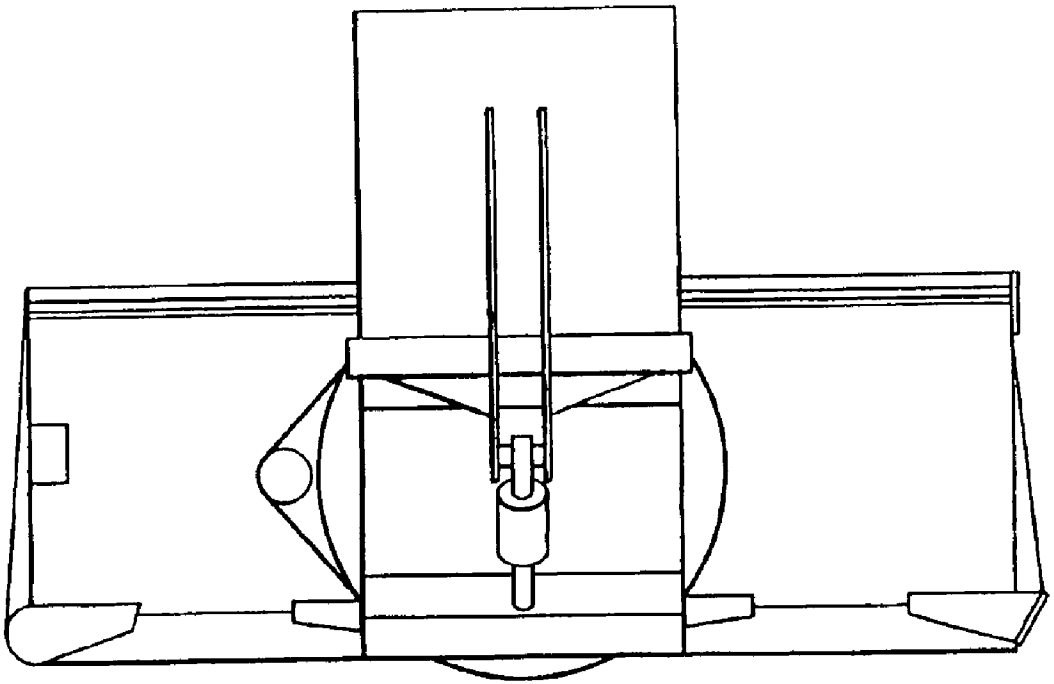
Figure 9:
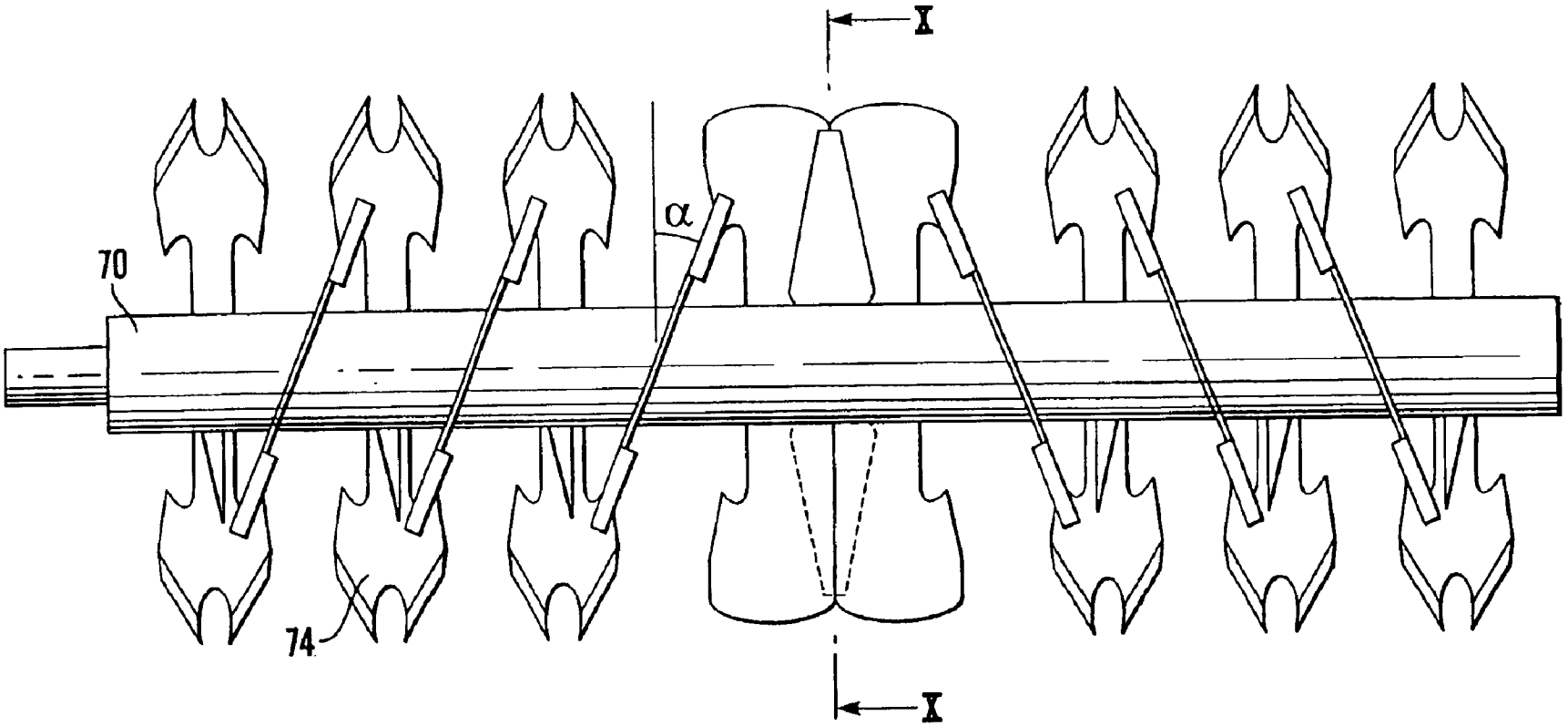
Figure 10:
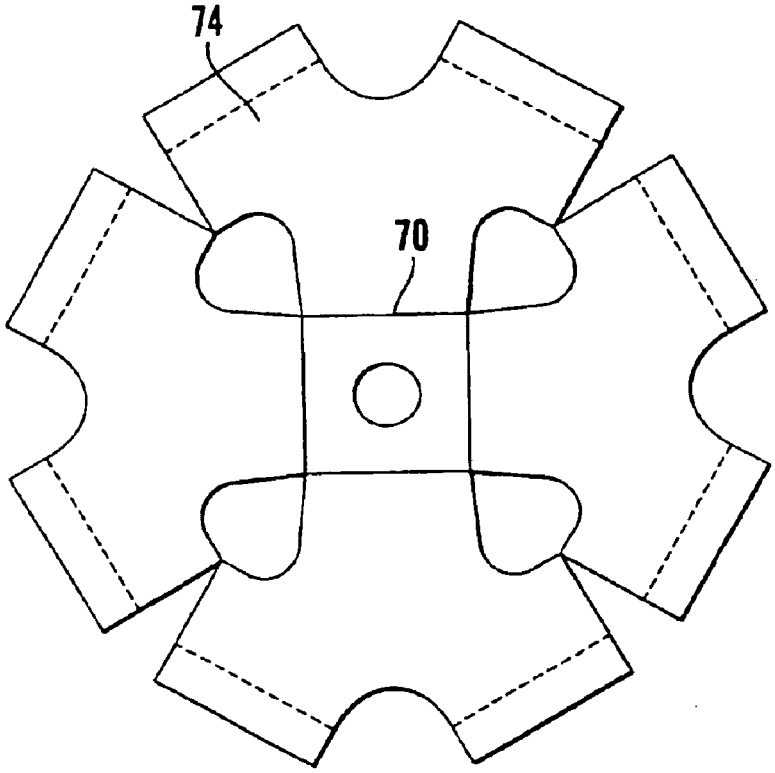
Figure 11:
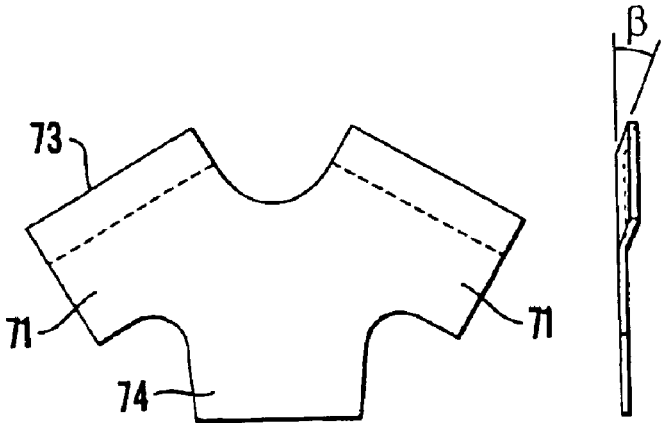
Figure 12:
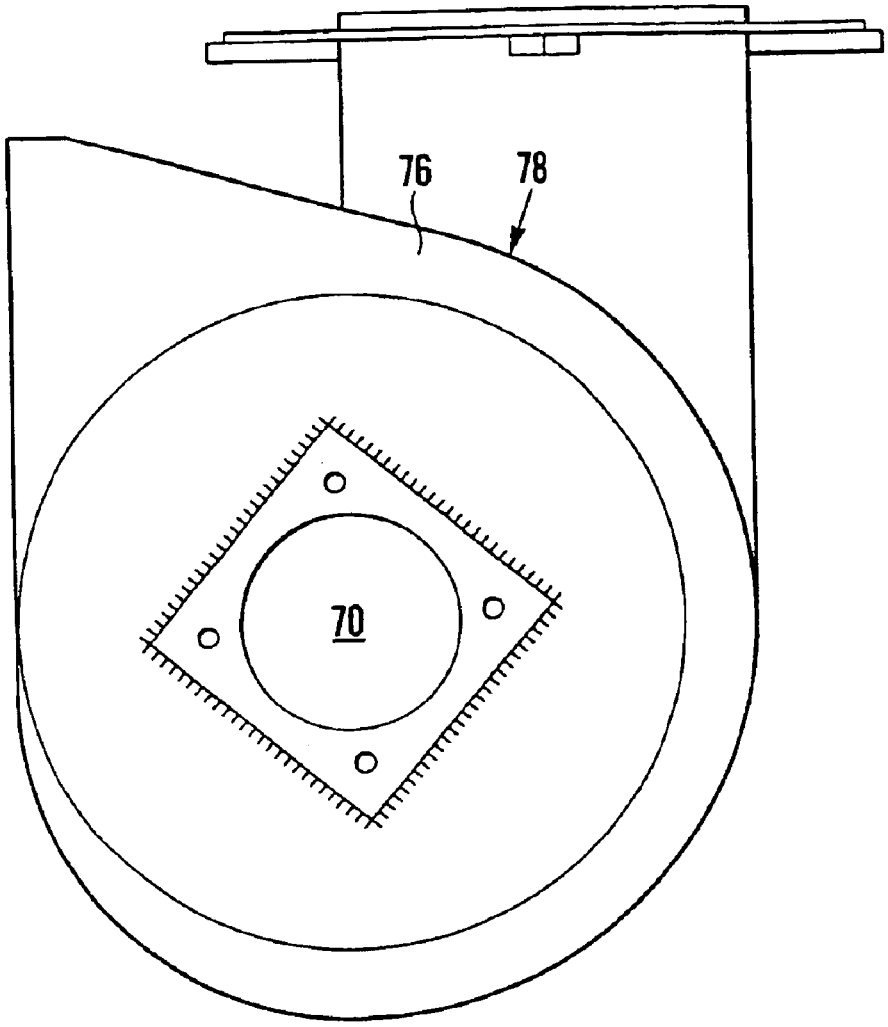
Figure 13:
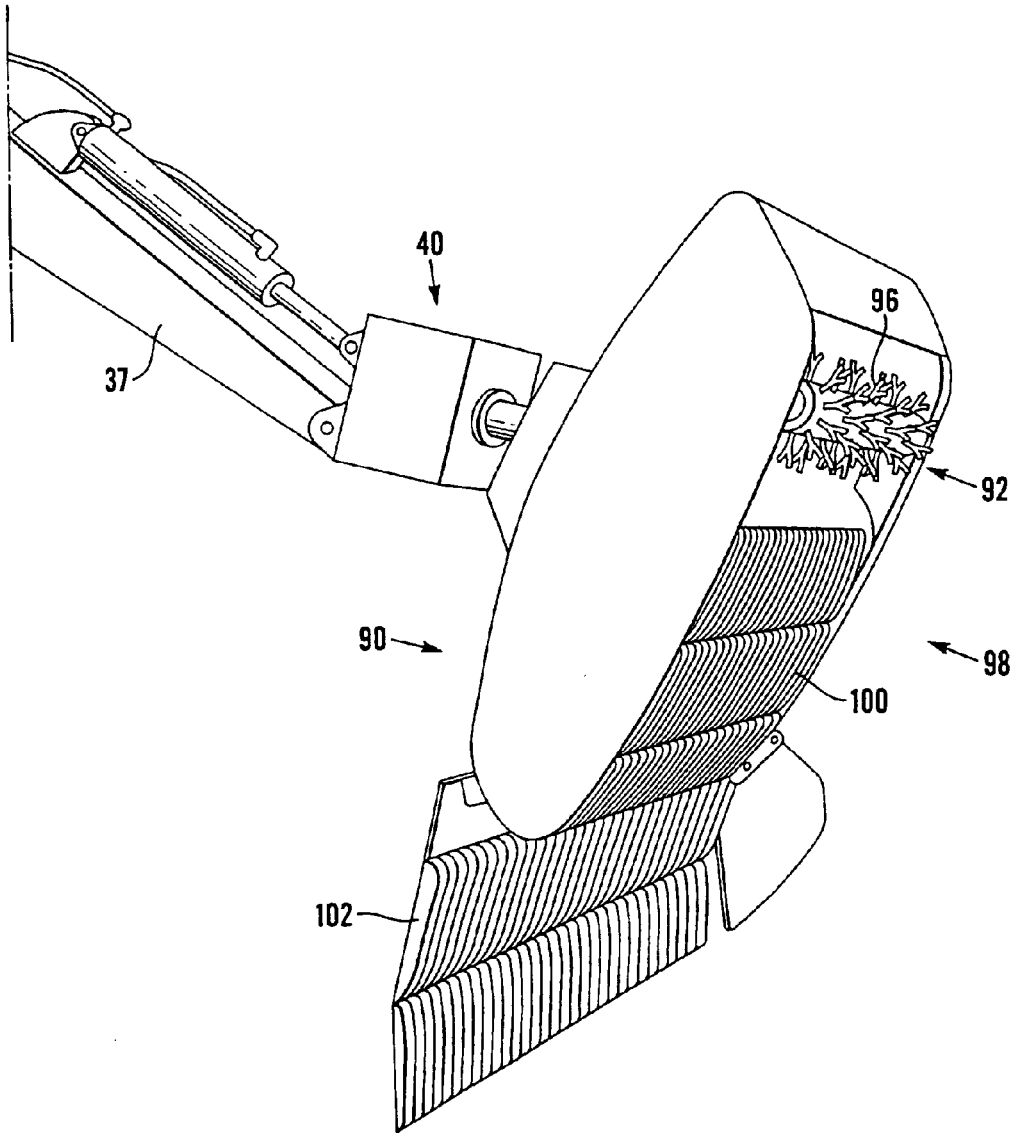
Figure 14:
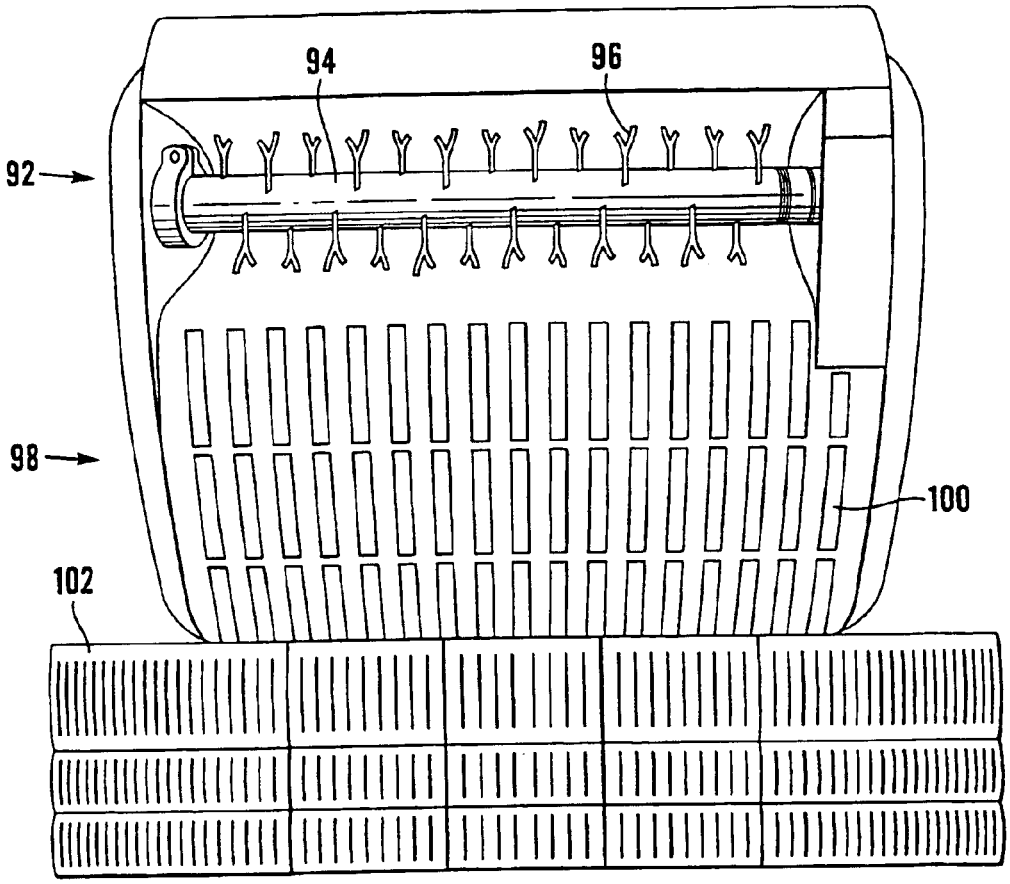
Figure 15:
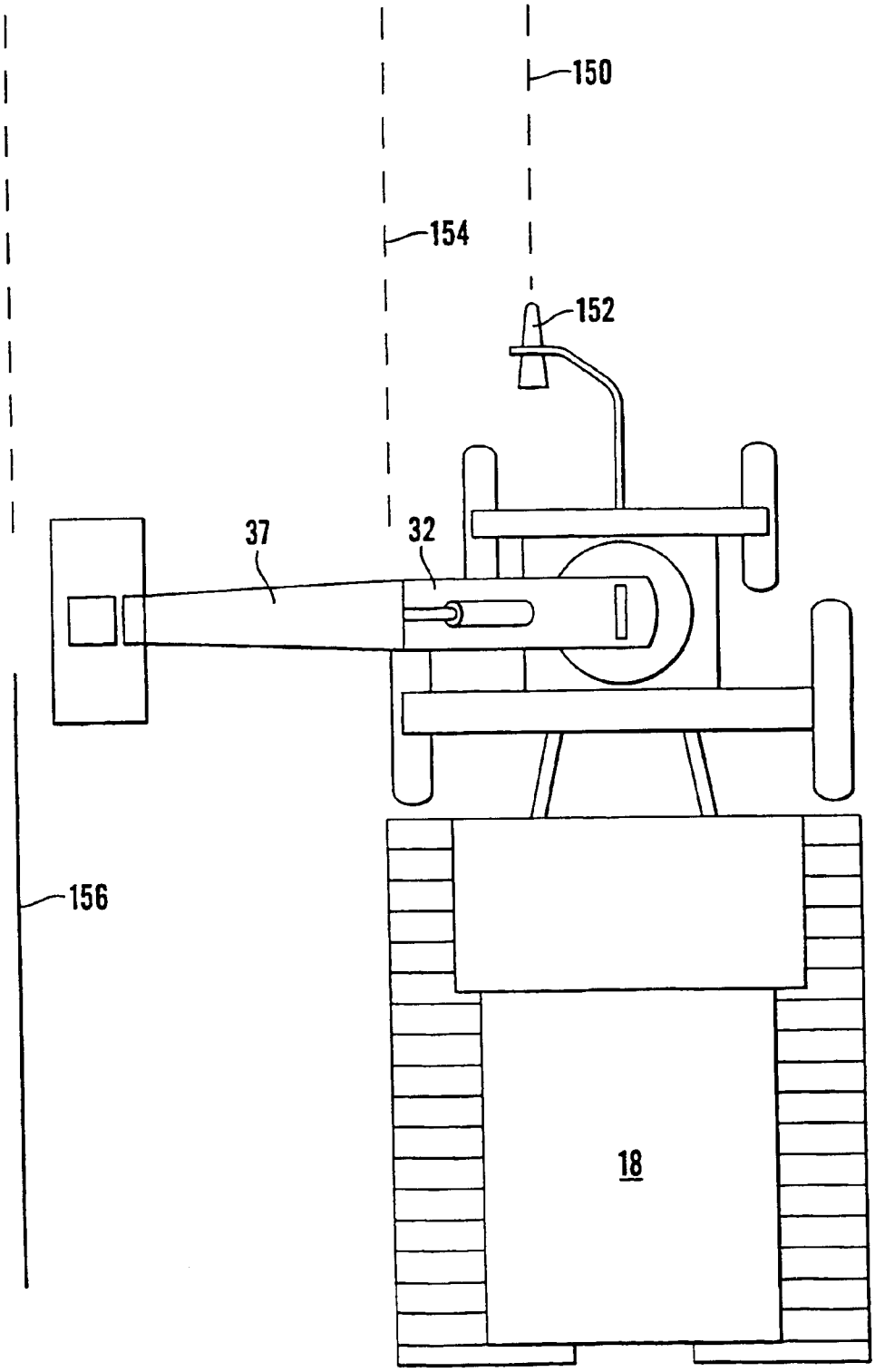

A first arm 72 is pivotally arranged to the lower part of the column, to the left in FIG. 3. A second arm arrangement, comprising two parallel arms, is pivotally arranged to the column a distance above the first arm. At the end of the second arm arrangement two support wheels 76 are rotatably arranged on each side of the arm arrangement. A cross-bar 78 is arranged between the end of the first arm 72 and the second arm arrangement. Further, a piston/cylinder arrangement 80 is arranged between the upper part of the column and the outer part of the first arm, stretching between the arms of the second arm arrangement.

A number of rods 82 are attached pivotally to each other as to form a linkage, where one end of the linkage is pivotally attached to the lower end of the column. The other end of the linkage is connected to the outer part of the first arm via a cross-bar 84. A further cross-bar 86 is also arranged between the linkage and the first arm at a distance closer to the column. A plurality of sets of wheels 88 are rotatably arranged along the linkage.

To the right of the column, an identical set of arms, linkages and wheels are arranged as described above, with the exception that a hydraulic drive motor 90 is arranged at the end of the first arm and the second arm arrangement. Instead of two wheels at the end of the arms, as for the left side, there is one drive wheel 92 that is driven by the drive motor. Around the circumference of the drive wheel a number of protrusions 94 are arranged.

Around the drive wheel 92, the sets of wheels 88 of the linkages, the pressure wheels 66 and the support wheels 76, a flexible snow-finishing band 96 is arranged. The snow-finishing band comprises two bands 98 of a material that is flexible in the transversal direction but cannot be extended in the longitudinal direction, like for example rubber reinforced with carbon fibres. A plurality of snow working members 100 are attached to the bands transversal to the longitudinal direction of the bands such that a space is created between the bands. The snow-working members are elongated profiles of metal that in the embodiment shown have a U-shape in cross-section, where the legs of the profiles are directed outwards. The width of the drive wheel and its protrusions are arranged such as the protrusions fit in the space between the bands and are in contact with the profiles so as to thereby drive the snow-finishing band. Inside the snow-finishing band a plurality of guide plates 102 are arranged in order to guide the snow-finishing band in relation to the support wheels and the wheels of the linkage.

The function of the device will now be described. The device is attached to the connection plate 50 of the guide member 40. The longitudinal direction of the device will thus be parallel with the extension of the arm of the work unit 10.

During use the hydraulic cylinders of the work unit are manoeuvred in order to turn the pillar 30 and turn the boom 32 and the outreach 37. The guide member 40 at the end of the outreach, FIG. 5, permits a turning of the working unit around the axis 48 by its hydraulic motor and tilting of the snow-finishing device with the help of the rotation attachment 42 and the hydraulic cylinder 44. The hydraulic motor 45 on the outreach permits in and outgoing movement, i e shortening and extension of the length of the outreach. With the help of the cylinder 70 between the attachment plate and the column, the snow-finishing device may be tilted, also in order to follow the shape of the surface to be treated.

In all a large spectrum of movement and working area is obtained for the working unit due to the design of the device, where the work area comprises substantially half a sphere. It is therefore very easy to accurately follow the shape of a snow-surface. When a surface is to be finished the drive motor is driven thereby rotating the band. The drive motor can of course have a reverse direction of rotation, where the direction of rotation is chosen by the operator depending on the working conditions.

The operator can also activate the cylinders between the column and the arms. When the first arm is lifted the second arm arrangement is also lifted due to the cross-bar 78 and further the outer end of the linkage is lifted due to the cross-bar 84. The intermediate part of the linkage is lifted somewhat less due to the crossbar 86, which in all creates a curvature of the linkage. The more the arm is lifted the more curved will the linkage become. This enables the operator to continuously and steplessly adapt the underside of the snow-finishing device to the shape of the surface or in order to create a certain shape of the surface. FIGS. 5–15 show some of the shapes that the underside of the snow-finishing device can have. The spring-loaded rod 64 with its pressure wheels 66 creates and maintains a tension of the snow-working band during use and during change of shape of the underside of the snow-finishing device. The movable, and not stiff, tensioning of the snow-working band provides a continuous movement of the snow-working band, which prevents packing of snow inside the device, especially wet snow which tends to pack and obstruct the use.

The rotation of the snow-finishing band causes the snow-working members 102 to scrape the surface, ie to move the top-layer of the surface in the direction of rotation. This can be done in order to fill cracks, grooves and the like marks in the snow surface, or to move small amounts of snow from one place to another. Due to the ability to change the shape of the underside of the snow-finishing device according to the invention continuously and steplessly by the operator, any changes in the shape of the surface can be taken care of easily and quickly. In all, the operator has full control of the finishing work and full freedom to create and maintain any shapes.

Preferably, all the hydraulic equipment of the snow-finishing device according to the invention are connected via the work to hydraulic system of the snow-grooming vehicle or any other suitable machine.

It is to be understood that the invention as described above and shown in the drawings only is to be regarded as non-limiting examples of the present invention and that it is defined by the following patent claims.

What is claimed is:

1. Device for working a snow surface, comprising an endless flexible band, snow-working members arranged on the outside of the band, a support structure for supporting and guiding the band, drive elements capable of moving the band around the support structure, wherein the support structure comprises a plurality of support elements pivotally linked to each other to form a linkage, shaping elements co-acting with said support structure and said linkage such as to be capable of changing the shape of the flexible band that is in contact with the snow-surface while the band is moving around the support structure, from a mainly convex form to a mainly planar form as seen in a direction transverse to the moving direction of the band.

2. Device according to claim 1, wherein the shaping elements are capable of changing the curvature of the part of the band that is in contact with the snow-surface while the band is moving around the support structure, continuously and steplessly.

3. Device according to claim 1, wherein the drive elements are capable of moving the band in both directions.

4. Device according to claim 1, which further comprises an attachment means for attachment to a maneuvering means that it is maneuverable with at least one degree of freedom.

5. Device according to claim 4, wherein the maneuvering means comprises a substantially vertical first arm in the form of a pillar, rotatably arranged around a turning axis substantially coinciding with its longitudinal axis, and at least a second arm in the form of a boom, rotatably arranged with one end to the pillar around a turning point arranged substantially perpendicular to the turning axis of the pillar, and a third arm comprising an outreach, rotatably arranged on the other end of the boom around a turning point arranged substantially horizontal and perpendicular to the longitudinal directions of the boom and the outreach.

6. Device according to claim 5, wherein a guide means is rotatably arranged on the free end of the outreach and perpendicular to the longitudinal direction of the outreach, and the guide means is arranged with an attachment member by which a working unit can be detachably attached.

7. Device according to claim 6, wherein the guide means comprises a hydraulically maneuverable rotatable shaft to which the attachment member is attached.

* * * * *